United States Patent [19]

Kamp et al.

[11] Patent Number: 4,572,459

[45] Date of Patent: Feb. 25, 1986

[54] CONTROLLABLE AND ADJUSTABLE YARN TENSIONER

[75] Inventors: Heinz Kamp, Wegberg; Wilhelm Zitzen, Mönchengladbach, both of Fed. Rep. of Germany

[73] Assignee: W. Schlafhorst & Co., Monchen-Gladbach, Fed. Rep. of Germany

[21] Appl. No.: 585,971

[22] Filed: Mar. 5, 1984

[30] Foreign Application Priority Data

Mar. 3, 1983 [DE] Fed. Rep. of Germany ..... 3307491

[51] Int. Cl.[4] ..... B65H 59/22

[52] U.S. Cl. ..... 242/150 R; 242/131

[58] Field of Search ..... 242/150 R, 149, 147 R, 242/129.8, 131, 131.1

[56] References Cited

U.S. PATENT DOCUMENTS

| | | | |
|---|---|---|---|
| 3,459,389 | 8/1969 | Wildi et al. | 242/150 R |
| 4,175,718 | 11/1979 | Derichs et al. | 242/150 R |
| 4,202,511 | 5/1980 | Koslowski | 242/150 R |
| 4,272,038 | 6/1981 | Wildi | 242/150 R |
| 4,398,681 | 8/1983 | Kupper | 242/150 R |

*Primary Examiner*—Stanley N. Gilreath

*Attorney, Agent, or Firm*—Herbert L. Lerner; Laurence A. Greenberg

[57] ABSTRACT

A controllable and adjustable yarn tensioner having two rotationally driven brake plates, between which yarn to be placed in tension is guided, includes first and second rotationally supported shafts, one of the brake plates being disposed at one end of the first shaft, the other end of the first shaft having an operative connection with a driving device; the other of the brake plates being disposed at one end of the second shaft; both the first and the second shafts being in mutual alignment along a common rotary axis, the other end of the first shaft being also connected, via a transmission system disposed outside of the brake plates, to the other end of the second shaft; one of the two brake plates having a compression spring contributorily determining the braking force at which the brake plates are applied, whereby the braking force is adjustable by adjusting the length of the spring; the first shaft being axially slideable; and a brake plate-disengagement device connected to the first shaft.

12 Claims, 2 Drawing Figures

CONTROLLABLE AND ADJUSTABLE YARN TENSIONER

Figure 1:
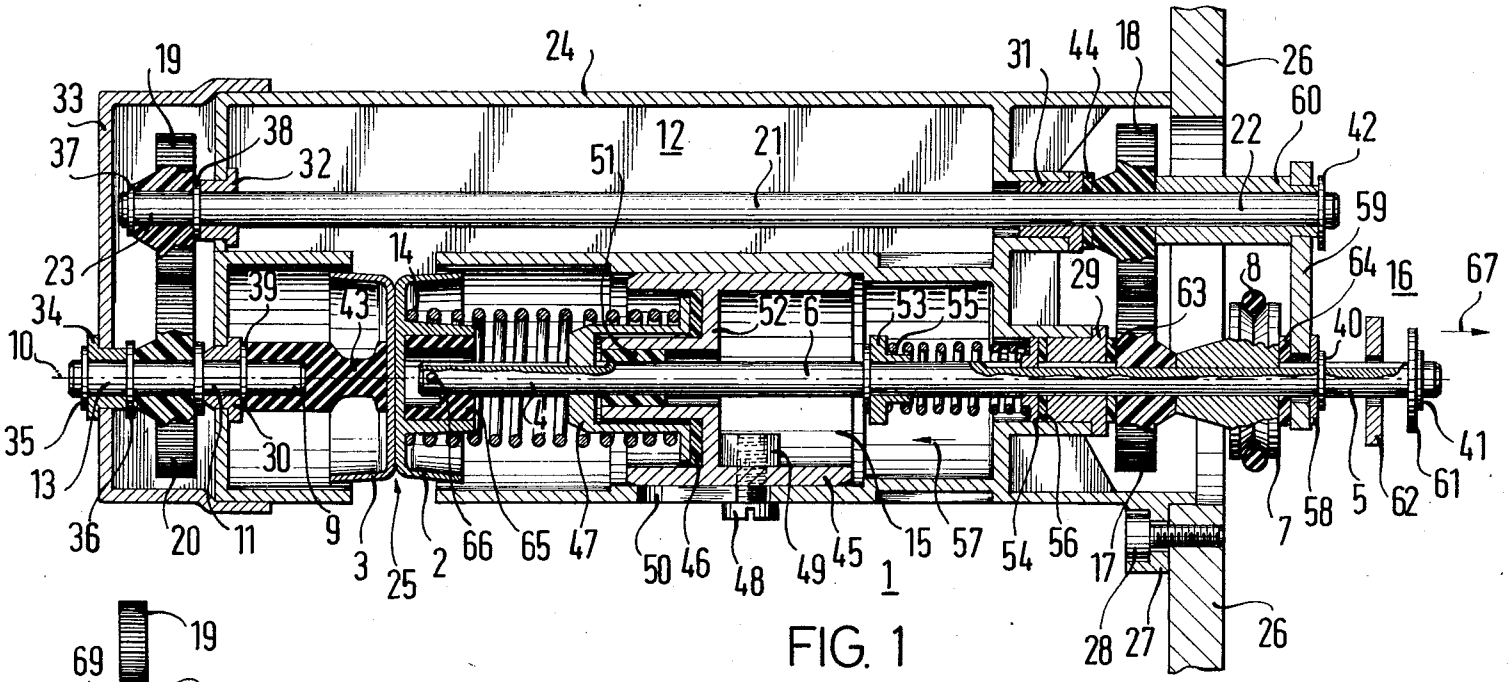

The invention relates to a controllable and adjustable yarn tensioner having two rotatingly driven brake plates between which yarn which is to be tensioned is guided.

In yarn tensioners of this general type, a central shaft is usually provided which extends through both brake plates, and serves simultaneously as a so-called rope friction brake for the yarn.

A disadvantage of such a construction is that the fibers and the threads can wind themselves around the shaft and, if the shaft or its covering serve also as a rope friction brake, they become notched or grooved by the thread and, in the course of time, are rendered useless. Even before that occurs, the brake values vary slowly and insidiously, with consequent disadvantageous effects upon the tension of the yarn.

It is accordingly an object of the invention to provide an universally applicable yarn tensioning device or tensioner which avoids the foregoing disadvantages of heretofore known devices of this general type and wherein, more particularly, the problem of wearing of the parts which are in contact with the thread or yarn is optimally solved.

With the foregoing and other objects in view, there is provided in accordance with the invention, a controllable and adjustable yarn tensioner having two rotationally driven brake plates, between which yarn to be placed in tension is guided, comprising first and second rotationally supported shafts, one of the brake plates being disposed at one end of the first shaft, the other end of the first shaft having an operative connection with a driving device; the other of the brake plates being disposed at one end of the second shaft; both the first and the second shafts being in mutual alignment along a common rotary axis, the other of the first shaft being also connected, via a transmission system disposed outside of the brake plates, to the other end of the second shaft; one of the two brake plates having a compression spring contributorily determining the braking force at which the brake plates are applied, whereby the braking force is adjustable by adjusting the length of the spring; the first shaft being axially slidable; and a brake plate-disengagement device connected to the first shaft.

In accordance with another feature of the invention the transmission system is a gear transmission having a first gear axially slideably mounted at the other end of the first shaft yet fixed against relative rotation with the first shaft; a second gear meshing with the first gear and mounted on a third shaft at one end thereof, the third shaft being rotationally supported and disposed parallel to the first and the second shafts and spaced from the brake plates; a third gear mounted at the other end of the third shaft; and a fourth gear mounted on the other end of the second shaft and meshing with the third gear.

In accordance with an additional feature of the invention there is provided a fourth shaft disposed parallel to the first, second and third shafts, and a fifth gear mounted on the fourth shaft between and meshing with the third and fourth gears.

In accordance with a further feature of the invention there is provided a fourth shaft disposed parallel to the first, second and third shafts, and a fifth gear mounted on the fourth shaft between and meshing with the first and second gears.

In accordance with an added feature of the invention at least one of the meshing pairs of the first and second gears, on the one hand, and the third and fourth gears, on the other hand, is exchangeable.

In accordance with again another feature of the invention there is provided a housing carrying and enclosing the transmission system, the shafts and support bearings for the shafts, the housing being formed with a gap therein for introducing a yarn therethrough between the brake plates, and a carrier element located at a side of the yarn tensioner at which the driving device is connected to the first shaft, the housing being fastened in an overhung position to said carrier element.

In accordance with still another feature of the invention the housing has an end facing away from the carrier element, and including a removable cover located at the housing end for covering at least part of the transmission system.

In accordance with yet a further feature of the invention the part of the transmission system comprises an exchangeable pair of mutually meshing gears.

In accordance with still a further feature of the invention there is provided means for adjusting the length of the compression spring, comprising a sleeve axially slideably supported in the housing, the sleeve carrying a slide ring whereon a spring plate abutting one end of the compression spring is supported, the spring plate being axially slideably mounted on the first shaft yet fixed against relative rotation with the first shaft, the sleeve having an adjusting element projecting out of the housing for determining and indicating the length and effect of the compression spring.

In accordance with again an additional feature of the invention the sleeve has a bearing support for the first shaft.

In accordance with again a further feature of the invention the first shaft has means for fixing the axial position thereof, said fixing means comprising a first spring plate connected to the first shaft so as to be fixed against relative rotation therewith, another compression spring, the other compression spring bearing against said first spring plate and also bearing against a second spring plate axially slideable on the first shaft yet fixed against relative rotation therewith, the second spring plate being in engagement with a stationary surface, and a disc connected to the first shaft also bearing against a stationary surface under the action of the other compression spring.

In accordance with a concomitant feature of the invention there is provided a brake plate-disengagement device located at a side of the yarn tensioner at which the driving device is connected to the first shaft, the brake plate-disengagement device comprising a disc mounted on the first shaft at the other end thereof, and a fork engageable with the disc for axially displacing the first shaft against the bias of the compression spring and for lifting the brake plates away from one another.

The invention thus provides, for example, the prerequisites for maintaining constant thread tension in a winding machine over long operation periods. The yarn tensioner according to the invention is universally applicable. It can be adjusted in a relatively simple manner with respect to the braking force, and adapted to the respective winding conditions with regard to the rotation of the brake plates. Conversion to different yarn dimensions, a different yarn material, a different yarn property and another winding speed cause no basic difficulties. Because the brake plates have no central openings and no rotating parts extending through these openings, neither the threads nor parts thereof can wind themselves around a rotating shaft or the like.

Other features which are considered as characteristic for the invention are set forth in the appended claims.

Although the invention is illustrated and described herein as embodied in a controllable and adjustable yarn tensioner, it is nevertheless not intended to be limited to the details shown, since various modifications and structural changes may be made therein without departing from the spirit of the invention and within the scope and range of equivalents of the claims.

Figure 2:
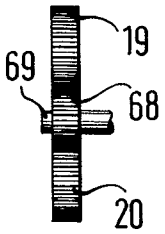

The construction and method of operation of the invention, however, together with additional objects and advantages thereof will be best understood from the following description of specific embodiments when read in connection with the accompanying drawings, in which:

FIG. 1 is a diagrammatic longitudinal sectional view of the yarn tensioner according to the invention; and FIG. 2 is a fragmentary view of FIG. 1 showing an alternative arrangement of the transmission or gearing thereof.

Referring now to the drawing and first, particularly, to FIG. 1 thereof, there is shown a yarn tensioning device 1 having a first brake plate 2 and a second brake plate 3. The first brake plate 2 is disposed at an end 4 of a rotatingly mounted first shaft 6. The other end 5 of the first shaft 6 has a drive connection formed of a pulley 7 and driving means such as a belt 8 to an otherwise non-illustrated driving device, such as a small drive motor, for example.

The second brake plate 3 is disposed of a first end 9 of a second rotatingly mounted shaft 11. Both shafts 6 and 11 are arranged serially i. e. behind one another, along the same axis of rotation 10, and are thus in alignment. The drive-side end 5 of the first shaft 6 is connected to a second end 13 of the second shaft 11 by a transmission 12 arranged outside the brake plates 2 and 3.

The first brake plate 2 is provided with a compression spring 14 which assists in establishing the braking force, the force of the spring 14 being adjustable by a spring-length adjusting device 15. The first shaft 6 is, furthermore, mounted so as to be slidable axially and is connected to a brake-plate disengaging device 16.

The transmission 12 is in the form of a gear transmission. The gear transmission 12 has, as a drive gear, a first gear 17 arranged so as to be slidable at the drive side end 5 of the first shaft 6 but fixed against rotation thereat, the first gear 17 meshing with a second gear 18 mounted on a third shaft 21. The shaft 21 is disposed and rotatably mounted parallel to the first and second shafts 6 and 11 at a spaced distance from the brake plates 2 and 3. The second gear 18 sits at the first end 22 of the shaft 21. The shaft 21, at the other end 23 thereof, carries a third gear 19 which meshes with a fourth gear 20 disposed at the rear end of the second shaft 11.

The yarn tensioner 1 is disposed in a housing 24 shown in section. The housing 24 surrounds the transmission 12, the shafts 6, 11 and 21, and is formed with an open gap 25 for inserting the yarn between the brake plates 2 and 3. At the drive side of the yarn tensioner, the housing 24 is fastened to a carrier element 26 in an overhung or cantilever position. The carrier element 26 may, for example, be the housing of a cross-wound coil or cheese winding device. For secure fastening, the housing 24 is provided with two or three mounting legs 27, one of which is visible in FIG. 1. To effect the fastening, screws 28 are provided.

The housing 24 also carries bearings for the shafts, in particular, a bearing 29 for the first shaft 6, a bearing 30 for the second shaft 11 and bearings 31 and 32 for the third shaft 21.

A removable cover 33 is located at the end of the housing 24 facing away from the fastening locations 27. The cover 33 covers the gears 19 and 20 of the transmission 12. The cover 33 also carries a bearing 34 for the second shaft 11.

Both gears 19 and 20 may be readily exchanged. For this purpose, a shaft retaining ring 35 is first removed from the shaft 11. The cover 33 is then pulled off from the housing 24 with the simultaneous withdrawal also of the bearing 34 from the shaft 11. After removal of another retainer ring 36 from the shaft 11, the gear 20 can be withdrawn from the shaft 11. After the retainer ring 37 is removed from the shaft 21, the gear 19 can also be taken off. Since both gears 19 and 20 have different diameters, they need only be mutually exchanged in order to change the motion of the brake plate 3 and the brake plate 2 relative to one another.

FIG. 1 shows the brake plate 3 cemented to an intermediate member 43 made of rubber, which forms a connection with the end 9 of the shaft 11. The intermediate member 43 bears against a retainer ring 39 of the shaft 11. The retainer ring 39 abuts the bearing 30. The position of the shaft 21 is secured by a retainer ring 38 which abuts from the outside against the bearing 32, and a retainer ring 44 which abuts from the outside against the bearing 31.

The spring length adjustment device 15 has a sleeve 45 which is axially slidably supported in the housing 24, the sleeve 45 carrying a slip or slide ring 46. A spring plate 47, which is mounted on the first shaft 6 so that it is slidable longitudinally yet fixed against relative rotation therewith, bears against the slide ring 46. The compression spring 14, at one side thereof, bears against the brake plate 2 and, at the other side thereof, against the spring plate 47. The sleeve 45 has an adjustment element 48 formed as a set screw which engages in the thread of a nut 49 connected to the sleeve 45. The adjustment element 48 has a head which projects to the outside through a slot 50 formed in the housing 24. To adjust the sleeve 45, and thereby adjust the compression spring 14, the adjustment element 48 is moved to a desired position in the slot 50 and then locked by tightening the screw. A projection 52 of the sleeve 45 supports not only the slide or slip ring 46 but also a support bearing 51 for the first shaft 6.

The first shaft 6 has a device for fixing the axial position thereof. This device is formed of a first spring plate 53 which is non-rotatably connected to the first shaft 6, a compression spring 55 being pressed against the spring plate 53 and also bearing against a second spring plate 54 which is connected slidably to but fixed against relative rotation with the first shaft 6. The spring plate 54, through the intermediary of the slide ring 56, bears against a stationary surface provided by the bearing 29. The pre-tensioned compression spring 55 is constrained to shift the first shaft 6 in direction of arrow 57. However, the path over which the shift occurs is limited by a disc in the form of a retainer ring 40 which bears, via a sliding or slip ring 58, against a stationary surface formed by a lug 59. The lug 59 is seated on a sleeve 60 which is freely rotatably stuck onto the end 22 of the third shaft 21, and secured by a retainer ring 42. The sleeve 60 is stationary relative to the rotary movement of the shaft 21, because the lug 59 is slipped onto the first shaft 6, as shown in FIG. 1.

A brake plate disengagement device is arranged at the drive-side end 5 of the first shaft 6. It is formed of a disc 61 located at the end 5 of the shaft, and a fork 62 engageable with the disc 61, and, thereby, also sliding the shaft 6 axially against the force of the spring 55 and, thereby, also lifting the brake plate 2 away from the brake plate 3. The disc 61 is secured by a retaining ring 41 against falling off from the shaft 6.

FIG. 1 shows that the gear 17 as well as the pulley 7 are mounted on the shaft 6 slidably yet fixed against rotation relative thereto. Spacer rings or washers 63 and 64 prevent the pulley 7 and the gear 17 axially following or moving together with the first shaft 6.

At all locations at which parts are mounted on the first shaft 6 so as to be fixed against rotation relative thereto yet axially slidable, the shaft 6 is provided with a flat and the respective parts have a projection which fits onto the flat, as shown in FIG. 1. The brake plate 2 is entrained by the shaft 6 through the intermediary of a rubber-elastic insert 65 formed with a longitudinal slot, and a pin 66 riding in the slot. During operation, the first shaft 6 rotates continuously. The first brake plate 2 is directly driven by the shaft 6. Due to the different diameters of the gears 19 and 20, the rotational velocity of the second brake plate 3 is somewhat smaller than the rotational velocity of the first brake plate 2. Thus, the brake plates have a relative motion with respect to one another, which is desirable in this case. By exchanging the two gears 19 and 20 it is possible to have the brake plate 3 rotate faster than the brake plate 2. If the two gears 19 and 20 are replaced, however, by two gears having the same diameter, both of the replacement gears will then rotate with the same number of revolutions, and there is no relative motion. This may be of advantage for processing delicate yarns. To open the yarn tensioner, the fork 62 is moved in the direction of the arrow 67. After making contact with the disk 61, the fork 62 entrains the whole shaft 6 in the direction of the arrow 67, thereby lifting the brake plate 2 away from the brake plate 3. It is sufficient to lift the brake plate 2 only a few millimeters away from the brake plate 3. The motion of the fork 62 may be effected by a conventional disengagement mechanism which is not shown in the drawing.

FIG. 2 shows diagrammatically an alternative configuration wherein, between the third gear 19 and the fourth gear 20, a fifth gear 68 is arranged on a fourth shaft 69. The gear 68 serves as means for reversing the direction of rotation. A result thereof is that the brake plate 3 revolves in a direction opposite that in which the brake plate 2 revolves. Alternatively, the shaft 69 and gear 68 may be provided between the first gear 17 and the second gear 18 for rotating brake plate 2 in a direction opposite that of brake plate 3. This may also be of advantage for special winding operations.

The invention thus offers many possibilities for an exact adaption for or accommodation to different yarn-handling conditions. The yarn tensioner is primarily provided for use in coil winding machines. The invention is not limited, however, to the illustrated and described embodiment used as an example.

We claim:

1. Controllable and adjustable yarn tensioner having two rotationally driven brake plates, between which yarn to be placed in tension is guided, comprising first and second rotationally supported shafts, one of the brake plates being disposed at one end of and in operative engagement with said first shaft, the other end of said first shaft having an operative connection with a driving device; the other of the brake plates being disposed at one end of and in operative engagement with said second shaft; both said first and said second shafts being in mutual alignment along a common rotary axis, said other end of said first shaft being also connected, via a transmission system disposed outside of said brake plates, to the other end of said second shaft; one of said two brake plates having a compression spring contributorily determining the braking force at which the brake plates are applied, whereby the braking force is adjustable by adjusting the length of the spring; said first shaft being axially slideable; and a brake plate-disengagement device connected to said first shaft for sliding said first shaft axially in a direction away from the other brake plate.

2. Yarn tensioner according to claim 1 wherein said transmission system is a gear transmission having a first gear axially slideably mounted at said other end of said first shaft yet fixed against relative rotation with said first shaft; a second gear meshing with said first gear and mounted on a third shaft at one end thereof, said third shaft being rotationally supported and disposed parallel to said first and said second shafts and spaced from the brake plates; a third gear mounted at the other end of said third shaft; and a fourth gear mounted on said other end of said second shaft and meshing with said third gear.

3. Yarn tensioner according to claim 2 including a fourth shaft disposed parallel to said first, second and third shafts, and a fifth gear mounted on said fourth shaft between and meshing with said third and fourth gears.

4. Yarn tensioner according to claim 2 including a fourth shaft disposed parallel to said first, second and third shafts, and a fifth gear mounted on said fourth shaft between and meshing with said first and second gears.

5. Yarn tensioner according to claim 2 wherein at least one of the meshing pairs of said first and second gears, on the one hand, and said third and fourth gears, on the other hand, is exchangeable.

6. Yarn tensioner according to claim 1 including support bearings for said shafts, and a housing carrying and enclosing said transmission system, said shafts and said support bearing, said housing being formed with a gap therein for introducing a yarn therethrough between the brake plates, and a carrier element located at a side of the yarn tensioner at which said driving device is connected to said first shaft, said housing being fastened in an overhung position to said carrier element.

7. Yarn tensioner according to claim 6 wherein said housing has an end facing away from said carrier element, and including a removable cover located at said housing end for covering at least part of said transmission system.

8. Yarn tensioner according to claim 7 wherein said part of said transmission system comprises an exchangeable pair of mutually meshing gears.

9. Yarn tensioner according to claim 6 including means for adjusting the length of said compression spring, comprising a sleeve axially slideably supported in said housing, said sleeve carrying a slide ring whereon a spring plate abutting one end of said compression spring is supported, said spring plate being axially slideably mounted on said first shaft yet fixed against relative rotation with said first shaft, said sleeve having an adjusting element projecting out of said housing for determining and indicating the length and effect of said compression spring.

10. Yarn tensioner according to claim 9 wherein said sleeve has a bearing support for said first shaft.

11. Yarn tensioner according to claim 1 wherein said first shaft has means for fixing the axial position thereof, said fixing means comprising a first spring plate connected to said first shaft so as to be fixed against relative rotation therewith, another compression spring, said other compression spring bearing against said first spring plate and also bearing against a second spring plate axially slideable on said first shaft yet fixed against relative rotation therewith, said second spring plate being in engagement with a stationary surface, and a disc connected to said first shaft also bearing against a stationary surface under the action of said other compression spring.

12. Yarn tensioner according to claim 1 including a brake plate-disengagement device located at a side of the yarn tensioner at which said driving device is connected to said first shaft, said brake plate-disengagement device comprising a drsc mounted on said first shaft at said other end thereof, and a fork engageable with said disc for axially displacing said first shaft against the bias of said compression spring and for lifting the brake plates away from one another.

* * * * *